US005084945A

United States Patent [19]

Childers

[11] Patent Number: 5,084,945

[45] Date of Patent: Feb. 4, 1992

[54] LOCKBOX DETENT CLIP

[76] Inventor: C. L. Childers, 310 Spalding Lake Ct., Atlanta, Ga. 30360

[21] Appl. No.: 545,564

[22] Filed: Jun. 29, 1990

[51] Int. Cl.[5] ..... A44B 21/00; E05B 65/52

[52] U.S. Cl. ..... 24/530; 24/531; 24/326; 70/63

[58] Field of Search ..... 24/530, 531, 563, 541, 24/543, 562, 326; 70/63

[56] References Cited

U.S. PATENT DOCUMENTS

| | | | |
|---|---|---|---|
| 1,224,762 | 5/1917 | McKeown | 24/563 |
| 2,260,584 | 10/1941 | Schuck et al. | 24/531 |
| 2,867,019 | 1/1959 | Streeter et al. | 24/563 |
| 3,122,987 | 3/1964 | Ruhnke | 24/326 |
| 3,247,558 | 4/1966 | Kaufman | 24/531 |
| 3,604,067 | 9/1971 | Brown | 24/326 |
| 3,934,434 | 1/1976 | Law | 70/63 |
| 4,799,370 | 1/1989 | Cooper | 70/63 |

FOREIGN PATENT DOCUMENTS

| | | | |
|---|---|---|---|
| 0226361 | 12/1924 | United Kingdom | 24/530 |

*Primary Examiner*—Victor N. Sakran
*Attorney, Agent, or Firm*—James A. Hinkle

[57] ABSTRACT

A detent clip adapted to fit around the edge of a door and positioned so that the clip prevents the swinging movement of a real estate lockbox attached to the handle of the door. The clip comprises a substantially U-shaped member, one leg of which has a projecting portion to bear against the lockbox thereby deterring its swinging movement when the door is opened or closed.

3 Claims, 2 Drawing Sheets

Fig. 2
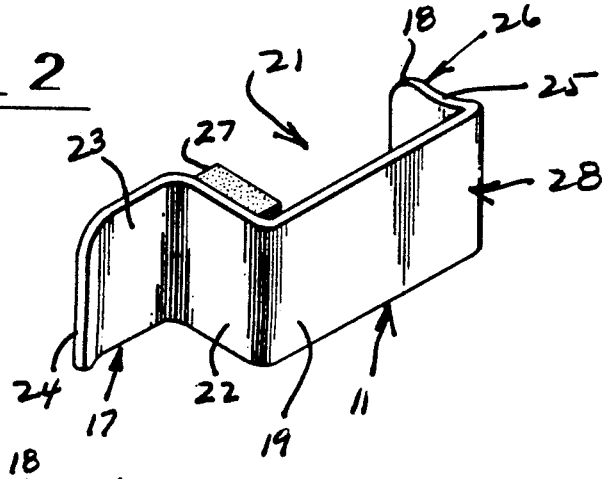
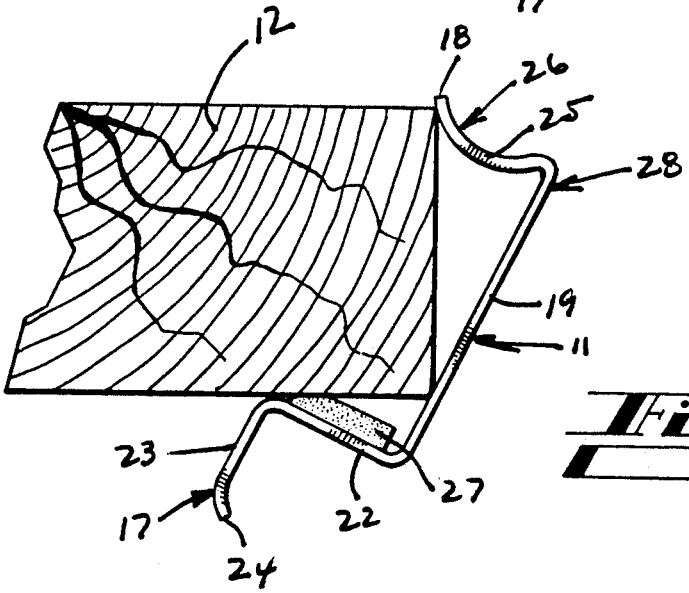
Fig. 3
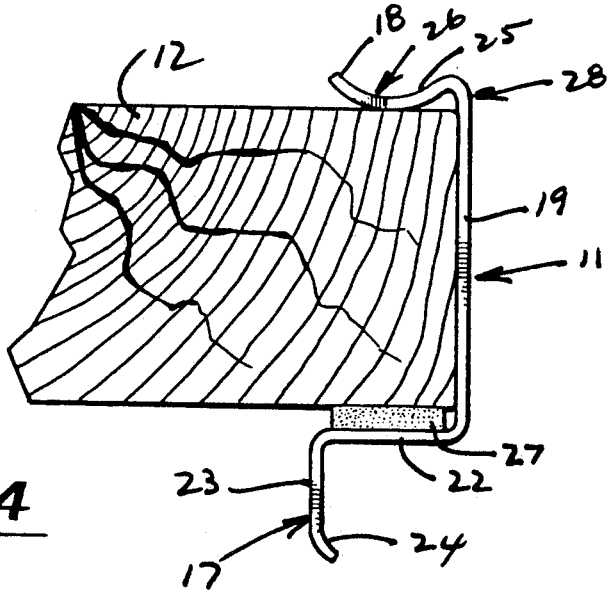
Fig. 4

LOCKBOX DETENT CLIP

BACKGROUND OF THE INVENTION

1. Field of the Invention

The present invention relates generally to the field of accessories which prevent damage to doors and, more particularly, to a device readily usable by real estate agents and like personnel which will prevent the marring and scarring of doors when a real estate lockbox is placed upon the door knob. Such lockboxes allow real estate agents ease of access to the property at desired times.

2. Description of the Prior Art

For many years in the real estate field it has been common that properties for sale would have, located on a door knob of a door to the property, a lockbox which contained a key for that particular property. The lockbox would be accessible only to qualified real estate agents who either had a key for the lockbox or a matching combination to gain entrance to the lockbox and the property key secured therein. The purpose of the lockbox is to allow real estate agents easy access to a listed property at desired times without the various real estate agents having to carry a multitude of keys for all possible listed properties.

However, one severe problem was found to occur with the lockboxes. Generally, the lockboxes tend to be rather cumbersome and heavy, by necessity, to prevent unauthorized tampering and vandalism of the box. Therefore, when the shackle of the lockbox was placed around the door knob the box would tend to swing around the door knob if the door was opened or closed rapidly. For instance, if the door was opened and then closed very quickly the lockbox would have a tendency to swing toward the near edge of the door and at about the time the door reached the door jam. In such a situation the lockbox frequently had swung to a position between the door and the door jam and this would cause the lockbox to be slammed against the door jam, frequently causing damage thereto. Another problem that is generally encountered is that the lockbox, when it swings upon opening and closing the door tends to scratch and mar the door facing.

In the pst, various devices have been proposed to remedy the above-noted deficiencies. One such remedy was to install a rub plate around the door knob s that the lockbox would not scar the door should it swing as the door was opened or closed. However, the protective plate did not prevent the lockbox from damaging the door jam if the box got caught between the door and the jam upon closing. To remedy the latter situation devices have been proposed which limit the swing of the lockbox, but these devices have not found great favor due to several deficiencies which made the devices either cumbersome to use or rather ineffective in their use.

SUMMARY OF THE INVENTION

In accordance with the present invention it is contemplated that a lockbox guard clip will be provided which will be attached to a door in such a manner so as to prevent a lockbox from swinging and moving towards the edge of the door when the door is opened or closed. The present invention contemplates a clip having a spring steel configuration which allows the clip to be snapped about the edge of a door, and yet be maintained in operative position without any fastening devices being utilized. The clip will generally employ a compressible resilient pad that is pressed tightly against the face of the door by the spring action of the metal clip design to maintain the clip in its intended position.

It is, therefore, an object of the invention to provide a novel and unique clip which prevents a real estate type lockbox from swinging into the area between the door and a door jam when the door is opened or closed.

It is yet another object of the invention to provide a lockbox clip designed to be installed upon a door wherein the clip is of relatively small size and is easily used by the real estate industry.

Yet another object of the invention is the provision of an easily manufactured, relatively inexpensive, effective lockbox clip which is readily adapted for use on a wide range of doors to prevent damaging motion of a real estate lockbox.

Other objects, advantages and capabilities of the invention will become apparent from the following description taken in conjunction with the accompanying drawings, showing only a preferred embodiment of the invention.

BRIEF DESCRIPTION OF THE DRAWINGS

FIG. 2 is a perspective view of the present invention;

FIG. 3 is a top view of the present invention being placed about a door to which the clip is to be affixed prior to the clip being fully positioned thereon;

FIG. 4 is a top view of the clip after it has been fully positioned on a door.

DESCRIPTION OF THE PREFERRED EMBODIMENT

Figure 1:
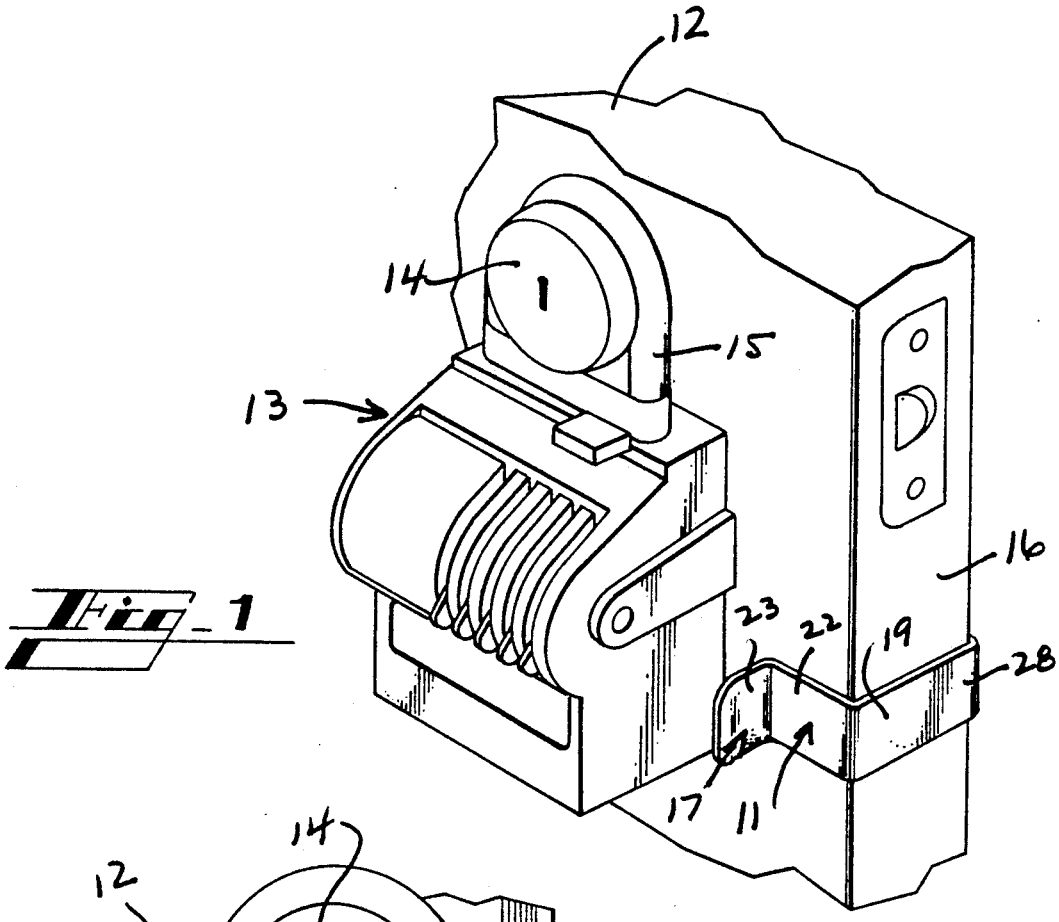
FIG. 1 is a partial overall perspective view showing a typical lockbox of one well-known design hanging on a door knob and showing the lockbox detent clip of the present invention in operative position.
Figure 5:
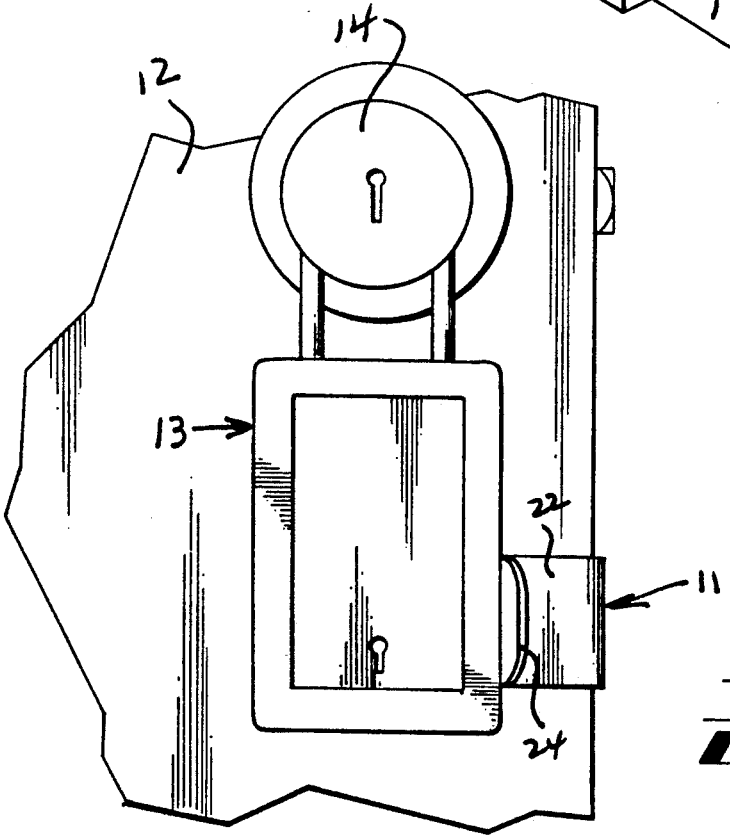
FIG. 5 is an elevation view of a partial section of a door showing a real estate lockbox of another design in position around a door knob with the lockbox detent clip of the present invention in position.

Referring to the drawings, wherein like numerals designate corresponding parts throughout the several figures, the detent clip of the present invention is generally indicated by the numeral 11. As is more clearly shown by the figures, the clip is adapted to fit around the edge of a door 12 to be juxtapositioned next to a real estate lockbox 13 of one or more of the common ordinary designs in the current use. As can be readily observed in FIGS. 1 and 5, the lockbox is typically hung around a door knob 14 by means of a shackle 15. The clip 11 is typically mounted to the door 12 by being snapped around the door edge 16.

The clip 11, in the preferred embodiment, comprises a proximal end 17 and a distal end 18 joined by a connector member 19. As is evident from the figures, the clip 11 comprises a stylized U-shaped clip structure defining a cupped shaped interior area which has been generally indicated in FIG. 2 by the numeral 21. Comprising the proximal end of the clip is a proximal leg 22 connected to one end of the connector member 19 and projecting therefrom at a substantially right angle thereto. The proximal leg 22 terminates with a lockbox stop flange 23 projecting from the free end of the proximal leg 22. The free end of the lockbox stop flange 23 generally terminates in a curved reentrant edge 24.

At the other end of the connector member 19, the distal end 18 generally comprises a distal leg 25 which projects from the connector member 19 at a substantially right angle thereto, which leg embodies a concave radius surface defining a retaining spring portion 26. To facilitate the clip being maintained around the door 12, it is preferred that a resilient gripper pad 27 be placed in secured relation to the inside of the proximal leg 22. By placing the gripper pad in such a relationship, the clip will be maintained upon the door in a secure and firm manner and will not be dislodged by impact of the lockbox against the clip.

In actual use, the clip would be installed upon the door 12 by placing the proximal leg 22 of the clip adjacent to the door 12 in a manner as shown in FIG. 3. At this point, the retaining spring portion 26 would just cover the far point of the door edge 16 and the user would then generally push upon the juncture of the connector member 19 and the distal leg 25, in the area designated by numeral 28, which pushing effort would then gently snap the clip about the door edge 16 and firmly place the clip in operative position to restrain the swinging of the lockbox 13. The compressible, resilient gripper pad 27 is then pressed tightly against the face of the door by the spring action of the retaining spring portion 26 of the distal leg 25. An important feature of the clip is the oversized, concave radius of the distal leg 25 that makes it possible to snap the clip onto the door with a rotating action that prevents the gripper pad 27 from being damaged. In addition, the spring action also increases the holding power of the clip by preloading the gripper pad with a sufficient force to prevent the clip from slipping from the door.

It has been found that the clip works equally well if made from stainless steel or from ordinary spring steel, and it is contemplated that the steel stock may range in thickness from 0.025 inch to 0.035 inch. In the manner just described, the clip 11 will have sufficient gripping force to maintain any size of the currently used lockboxes.

Various modifications may be made of the invention without departing from the scope thereof, and it is desired, therefore, that only such limitations shall be placed thereon as are imposed by the prior art and which are set forth in the appended claims.

What is claimed is:

1. A detent clip adapted to fit around the edge of a door to be in juxtaposition next to a lockbox to deter the lockbox from a swinging movement, said clip comprising:

a clip having an upstanding leg at the proximal end thereof and an upstanding leg at the distal end thereof, the upstanding leg at the proximal end of the clip has a blocking lip projecting outwardly from the leg at a substantially right angle thereto, the blocking lip deterring the swinging movement of the lockbox, said proximal and distal legs being joined by a connector member thereby forming a substantially U-shaped structure defining a cupped interior area, the cupped interior area of the clip being so formed to fit around the edge of said door, resilient gripping means mounted on the interior surface of the upstanding leg at the proximal end of the clip to provide a resilient gripping surface to the door when said clip is in its operative position.

2. The detent clip as claimed in claim 1, wherein said upstanding leg at the distal end of the clip is concave in shape to provide a retaining spring action to the clip for ease of installation and maintenance of the clip around the door edge.

3. A detent clip adapted to fit around the edge of a door to be in juxtaposition next to a lockbox to deter the lockbox from a swinging movement, said clip comprising:

a clip having an upstanding leg at the proximal end thereof and an upstanding leg at the distal end thereof, means integral with the upstanding leg at the proximate end of the clip to deter the swinging movement of the lockbox, said proximal and distal legs being joined by a connector member thereby forming a substantially U-shaped structure defining a cupped interior area, the cupped interior area of the clip being so formed to fit around the edge of said door, resilient gripping means mounted on the interior surface of the upstanding leg at the proximal end of the clip to provide a resilient gripping surface to the door when said clip is in its operative position.

* * * * *